US007162757B2

(12) United States Patent
Edgerton

(10) Patent No.: US 7,162,757 B2
(45) Date of Patent: Jan. 16, 2007

(54) LOCKING MECHANISM FOR A HOSPITAL BED

(75) Inventor: John Edgerton, Omro, WI (US)

(73) Assignee: Graham-Field Health Products, Inc., Atlanta, GA (US)

( * ) Notice: Subject to any disclaimer, the term of this patent is extended or adjusted under 35 U.S.C. 154(b) by 126 days.

(21) Appl. No.: 10/964,035

(22) Filed: Oct. 13, 2004

(65) Prior Publication Data

US 2005/0097672 A1 May 12, 2005

Related U.S. Application Data

(60) Provisional application No. 60/511,049, filed on Oct. 13, 2003.

(51) Int. Cl.
*A61G 7/05* (2006.01)
*A61G 7/012* (2006.01)

(52) U.S. Cl. ..... 5/600; 5/86.1; 5/509.1

(58) Field of Classification Search ..... 5/86, 5/1, 509.1; 280/47.12, 47.34
See application file for complete search history.

(56) References Cited

U.S. PATENT DOCUMENTS

| | | | | |
|---|---|---|---|---|
| 3,050,745 | A * | 8/1962 | Tabbert | 5/86.1 |
| 4,669,136 | A * | 6/1987 | Waters et al. | 5/601 |
| 5,615,451 | A * | 4/1997 | Peterson et al. | 16/34 |
| 6,363,556 | B1 * | 4/2002 | Krauska et al. | 5/618 |
| 6,473,921 | B1 * | 11/2002 | Brooke et al. | 5/600 |
| 2006/0026762 | A1 * | 2/2006 | Hornbach et al. | 5/611 |

* cited by examiner

*Primary Examiner*—Michael Trettel
(74) *Attorney, Agent, or Firm*—Brannen Law Office, LLC

(57) ABSTRACT

A locking mechanism for a hospital bed is mounted on an undercarriage of the bed. The locking mechanism includes a locking pedal and an unlocking pedal, which are side-by-side one another on the undercarriage. To lock the bed in position to prevent it from rolling, one depresses the locking pedal which, through a mechanical linkage, moves a brake member having a brake pad vertically downward into contact with the floor beneath the bed, and locks the brake pad into that position. By depressing the unlocking pedal, the mechanical linkage is pulled in the opposite direction to raise the brake member and brake pad from the floor, thereby unlocking the bed.

7 Claims, 14 Drawing Sheets

LOCKING MECHANISM FOR A HOSPITAL BED

CROSS-REFERENCE TO RELATED APPLICATION

This application is based on U.S. patent application Ser. No. 60/511,049, filed Oct. 13, 2003, and includes a claim for Convention priority based thereon.

BACKGROUND OF THE INVENTION

1. Field of the Invention

The present invention relates to the beds used in medical institutions and, more particularly, is a locking mechanism for such a bed.

2. Description of the Prior Art

Beds are ubiquitous in medical institutions, such as hospitals and nursing homes, and, in that setting, usually include a bed frame mounted on a wheeled base, which allows them to be used to move patients from one location to another. Height and angle adjustable beds are also used by medical institutions. Such beds may be raised and lowered between a high position and a low position, and the inclination of their mattresses may be adjusted at the head and foot thereof.

Mobile, wheeled hospital beds require some form of braking mechanism to prevent them from rolling while unattended. Conventional casters may have wheel locks mounted on the caster wheels, but caster wheel locks are unsuitable for use on a hospital beds, because locked caster wheels often fail to have sufficient friction on smooth hospital floors, as the caster wheels themselves are typically made of a hard plastic material. Moreover, it is often difficult for hospital staff members to determine whether the caster or casters are locked or unlocked, which may delay the movement of a patient in a critical situation. In addition, caster locks sometimes require hospital personnel to reach down to lock or unlock the casters.

SUMMARY OF THE INVENTION

The present invention is a locking mechanism for a hospital bed comprising a locking pedal pivotably mounted to a support member of a hospital bed undercarriage, an unlocking pedal pivotably mounted to the same support member, and a vertically extending braking mechanism, which is operably linked to the locking pedal and the unlocking pedal, such that the pivoting the locking pedal to a locking position causes a brake to descend vertically and make contact with the floor. More specifically, by depressing the locking pedal to a locking position, the brake is locked into a braking position in contact with the floor. By pivoting the unlocking pedal to an unlocking position, the brake is released and moves vertically upward away from the floor. A biasing mechanism, such as a spring, may be used to force the brake to move upward when released.

One advantage of the present invention is that the braking mechanism may have a floor-contacting surface with a high coefficient of friction even relative to smooth hospital floors or on floors that are wet. Another advantage is that the rotating pedals may extend from the undercarriage of the bed to provide mechanical advantage for locking and unlocking the brake. Yet another advantage is that the locking and unlocking pedals may be positioned side-by-side. Still another advantage is that the pedals may be color-coded or given some other indication to quickly show whether the hospital bed is locked or unlocked. For example, the locking pedal may be colored red and the unlocking pedal may be colored green, enabling hospital staff members to tell at a glance whether the red locking pedal is engaged, locking the bed, or disengaged, unlocking the bed.

Other features and advantages of the present invention will become apparent from the following description of the invention which refers to the accompanying drawings.

DETAILED DESCRIPTION OF THE PREFERRED EMBODIMENTS

Figure 1:
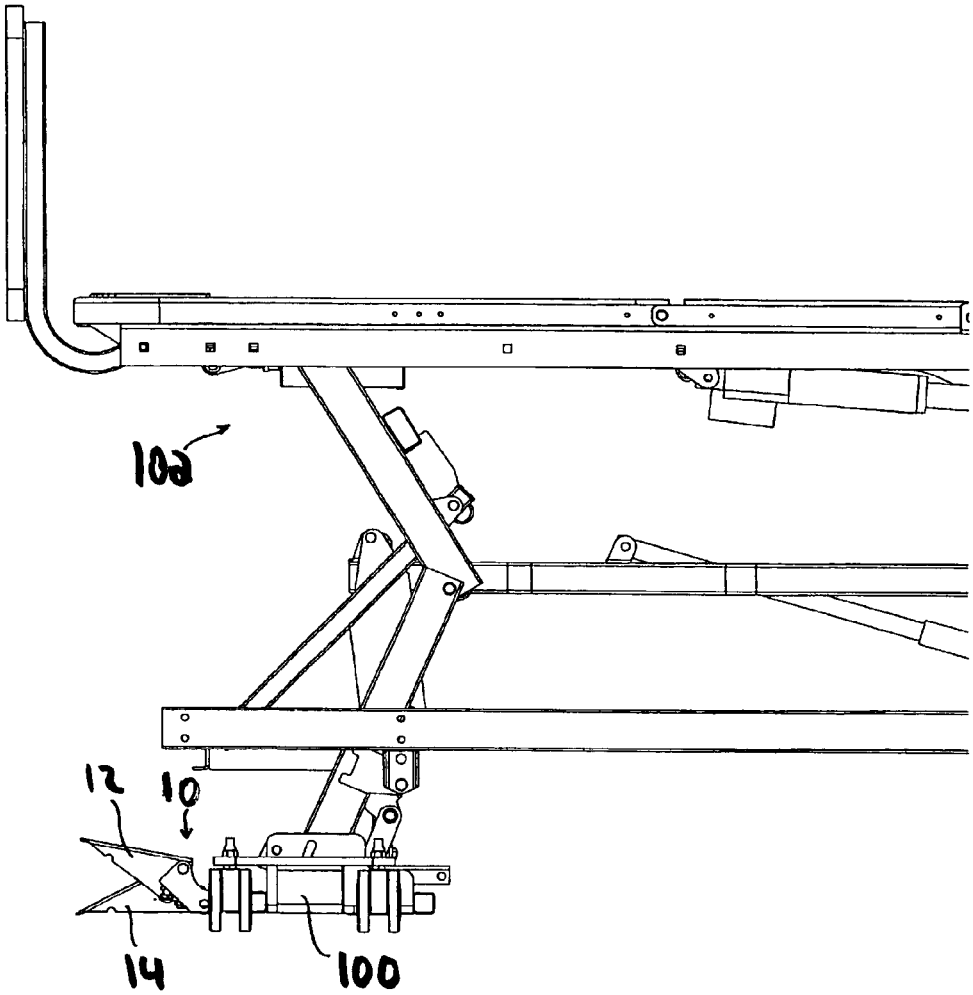
FIG. 1 is a side view of an end of a hospital bed having the locking mechanism of the present invention attached to the undercarriage thereof.

In a preferred embodiment, the present locking mechanism for a hospital bed is installed on an undercarriage of a hospital bed, such as the bed disclosed in co-pending U.S. patent application Ser. No. 10/623,980, filed Jul. 21, 2003 and entitled "Height and Angle Adjustable Bed", of the present inventor, John Edgerton. Referring to FIG. 1, the undercarriage 100 rests on the floor and does not move vertically during the raising and lowering of the hospital bed 102. Accordingly, the locking mechanism 10 may be mounted to a crossbar of the undercarriage 100 and may lock the bed 102 in place, even when the bed 102 is being raised and lowered. The locking pedal 12, which may be of a distinctive color, such as red, is clearly in an unlocked position higher than that of the unlocking pedal 14 in FIG. 1. The locking pedal 12 may, for example, be painted red or have a red plastic covering, while the unlocking pedal 14 may, for example, be painted green or have a green plastic covering.

Figure 2A:
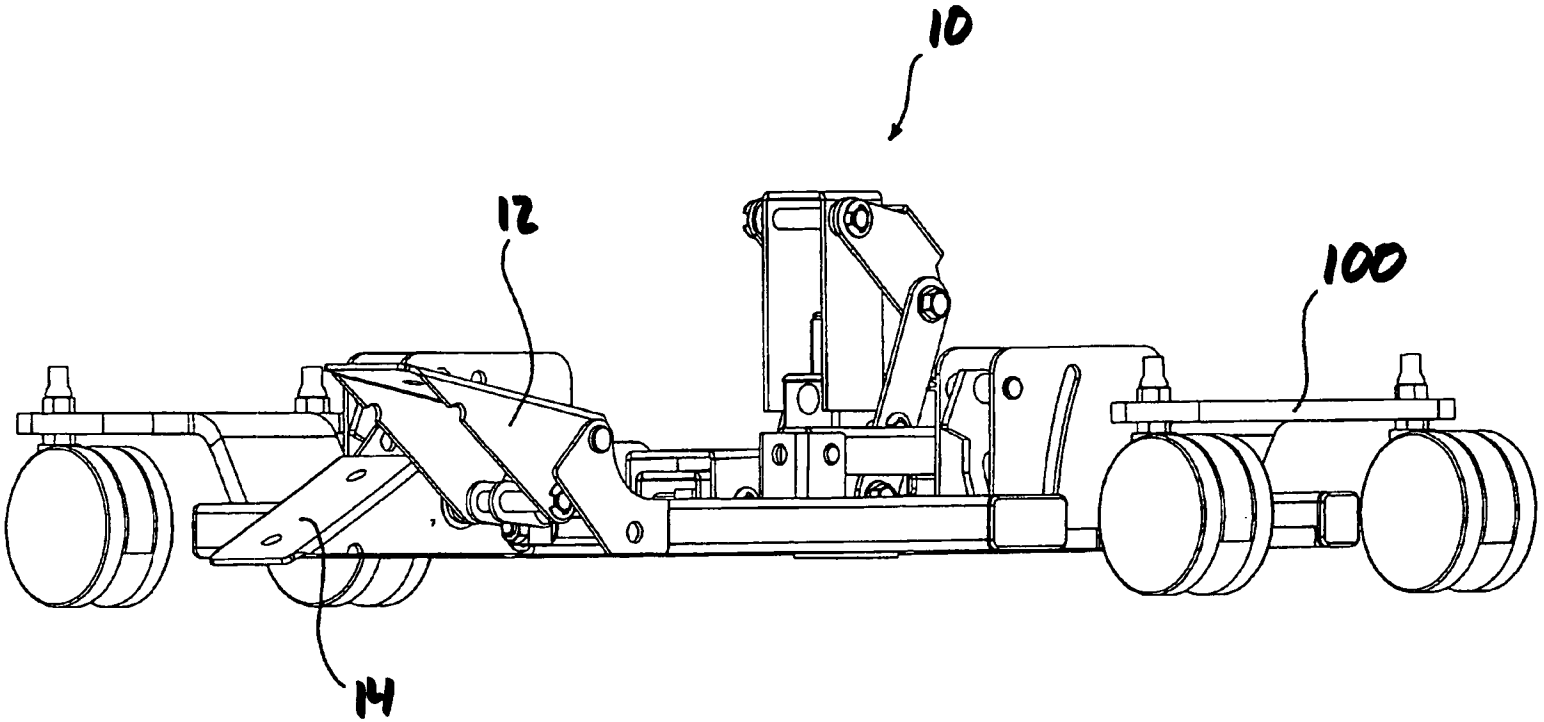
FIG. 2A is a perspective view, taken at floor level, of the undercarriage and locking mechanism of the present invention with the brake in an unlocked position.
Figure 2B:
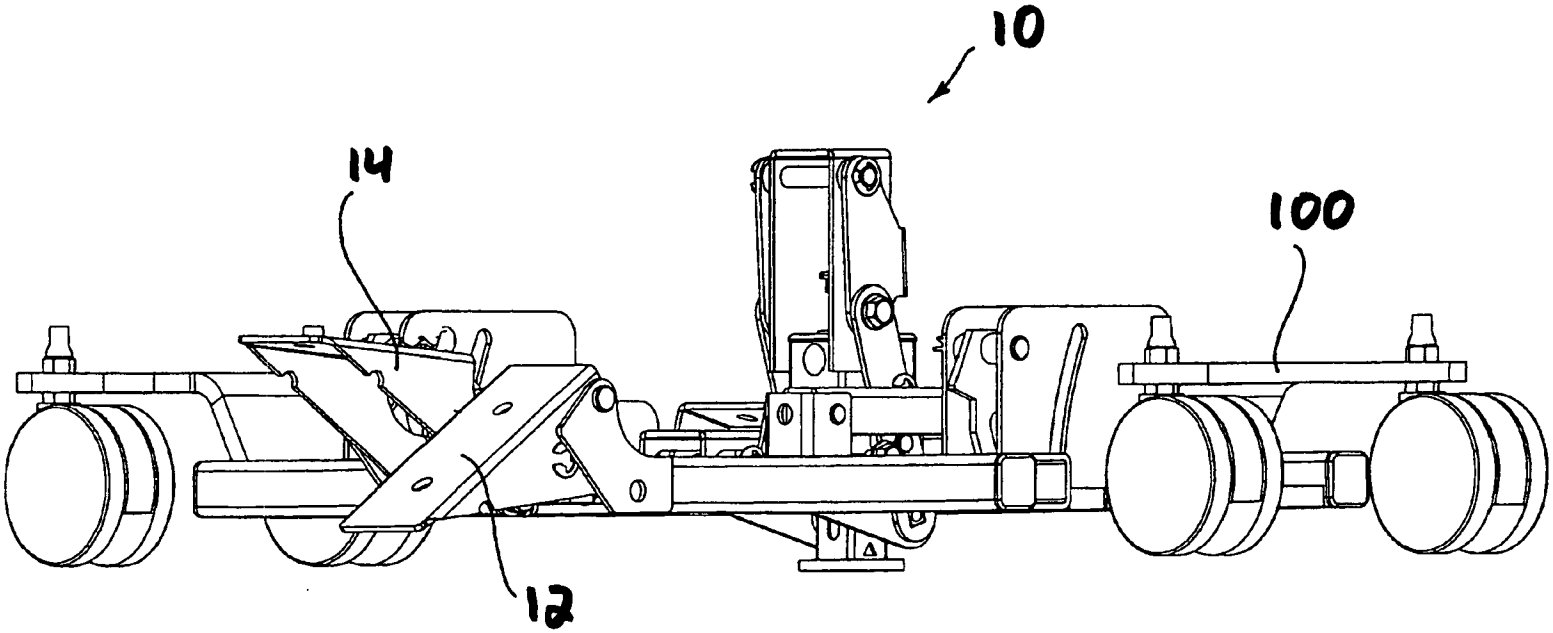
FIG. 2B is the perspective view given in FIG. 2A with the brake in a locked position.
Figure 5A:
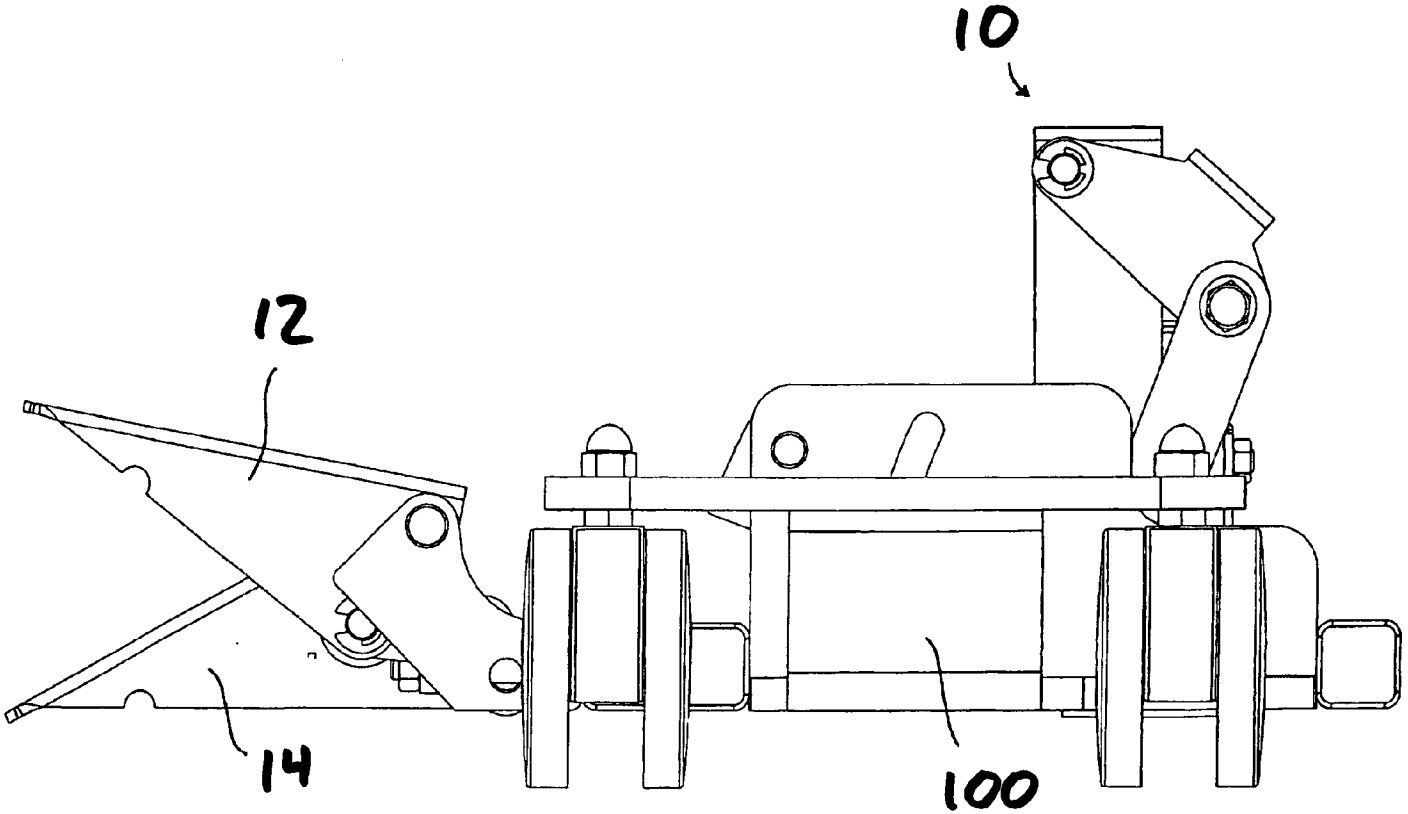
FIG. 5A is a side plan view, taken at floor level, of the undercarriage and locking mechanism with the brake in an unlocked position.
Figure 5B:
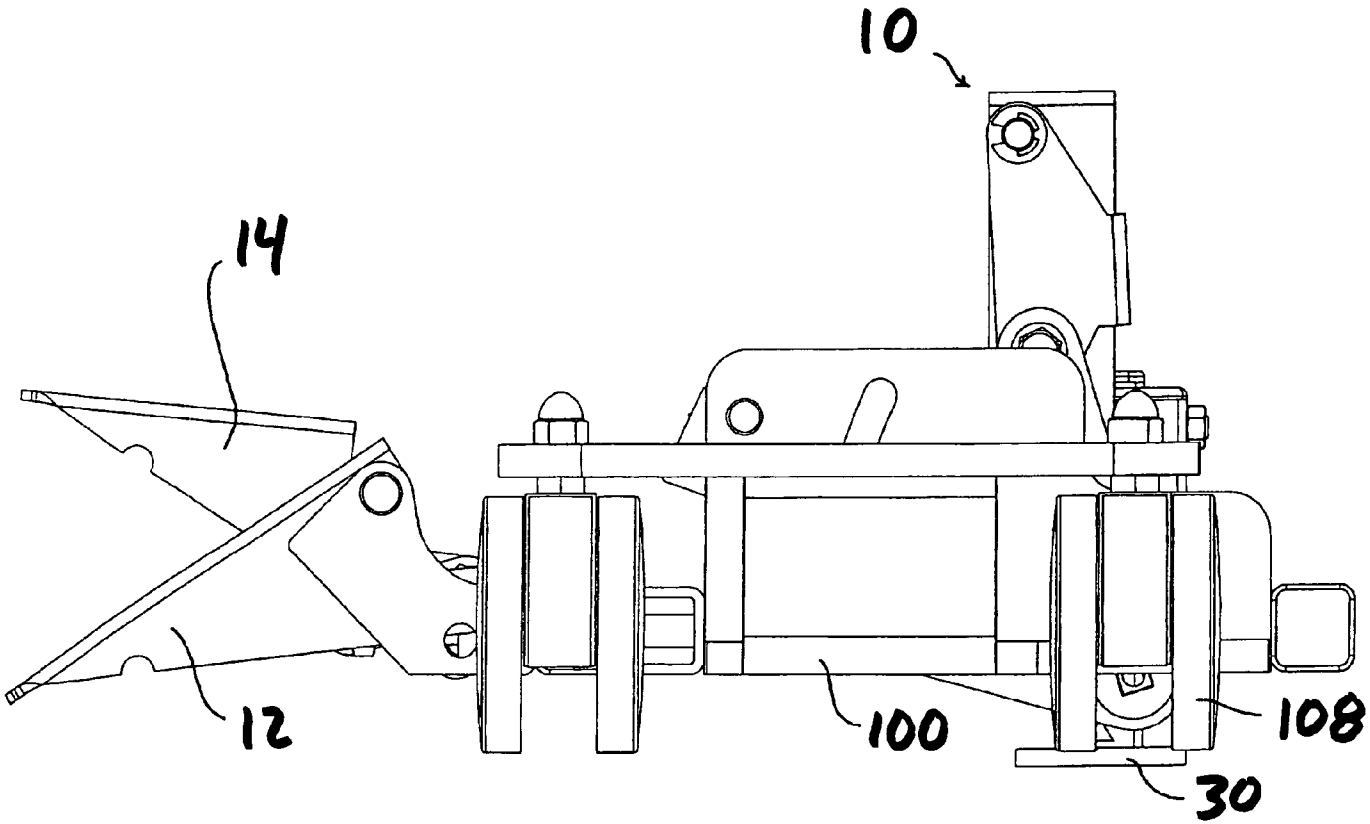
FIG. 5B is the view of FIG. 5A with the brake in a locked position.

With reference to FIGS. 2A, 2B, 5A and 5B, the locking pedal 12 is clearly in an unlocked position in FIGS. 2A and 5A and in a locked position in FIGS. 2B and 5B, as the locking pedal 12 is "up" in the former figures and "down" in the latter figures. Accordingly, personnel can quickly determine whether the locking mechanism 10 on the undercarriage 100 is in an unlocked or locked position. It should also be noted in FIG. 5B that the brake pad 30 may extend below caster 108 on undercarriage 100 when the braking mechanism 10 is locked. In practice, this means that brake pad 30 will bear a portion of the weight of the bed 102, increasing the frictional forces between the brake pad 30 and the floor and making it much more difficult to move the bed 102 when the locking mechanism 10 is engaged. Brake pad 30 is preferably made of a material having a high coefficient of friction relative to the floor, such as rubber.

Figure 3A:
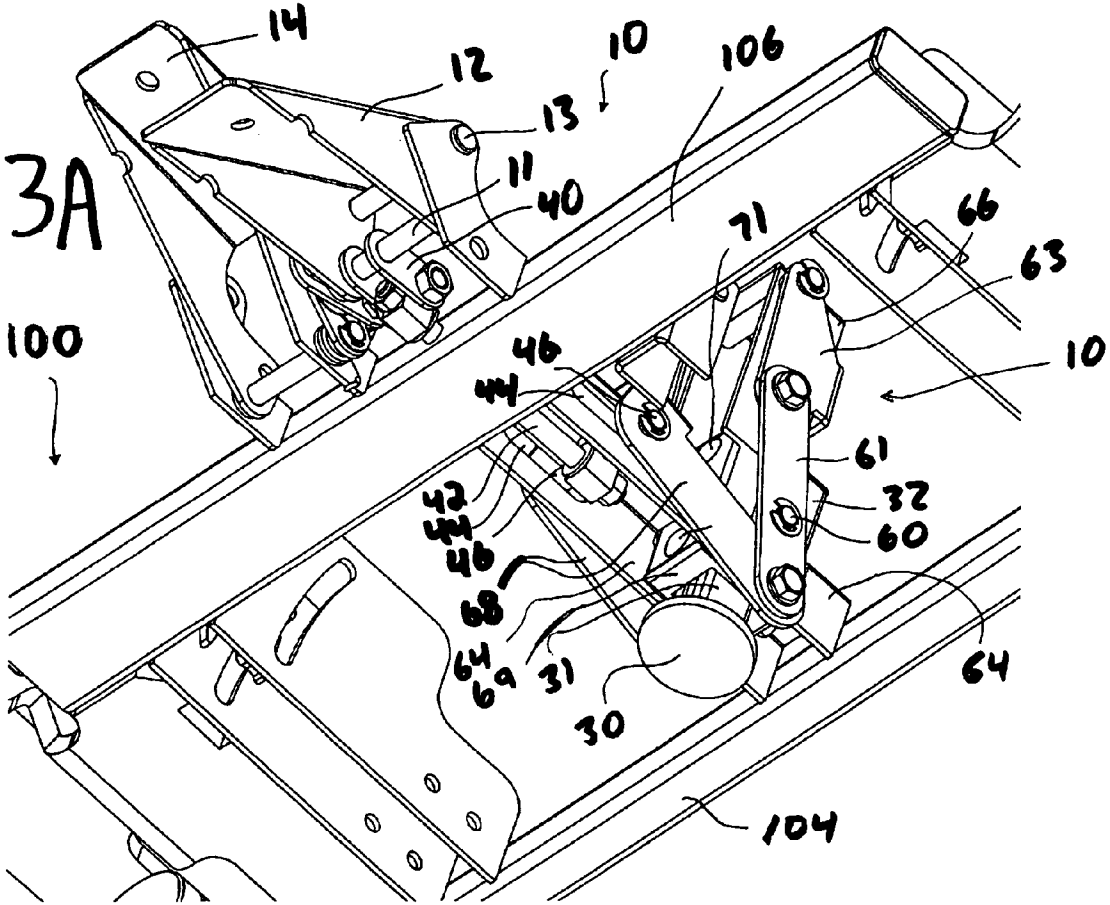
FIG. 3A is a perspective view from below the undercarriage and locking mechanism with the brake in a locked position.
Figure 3B:
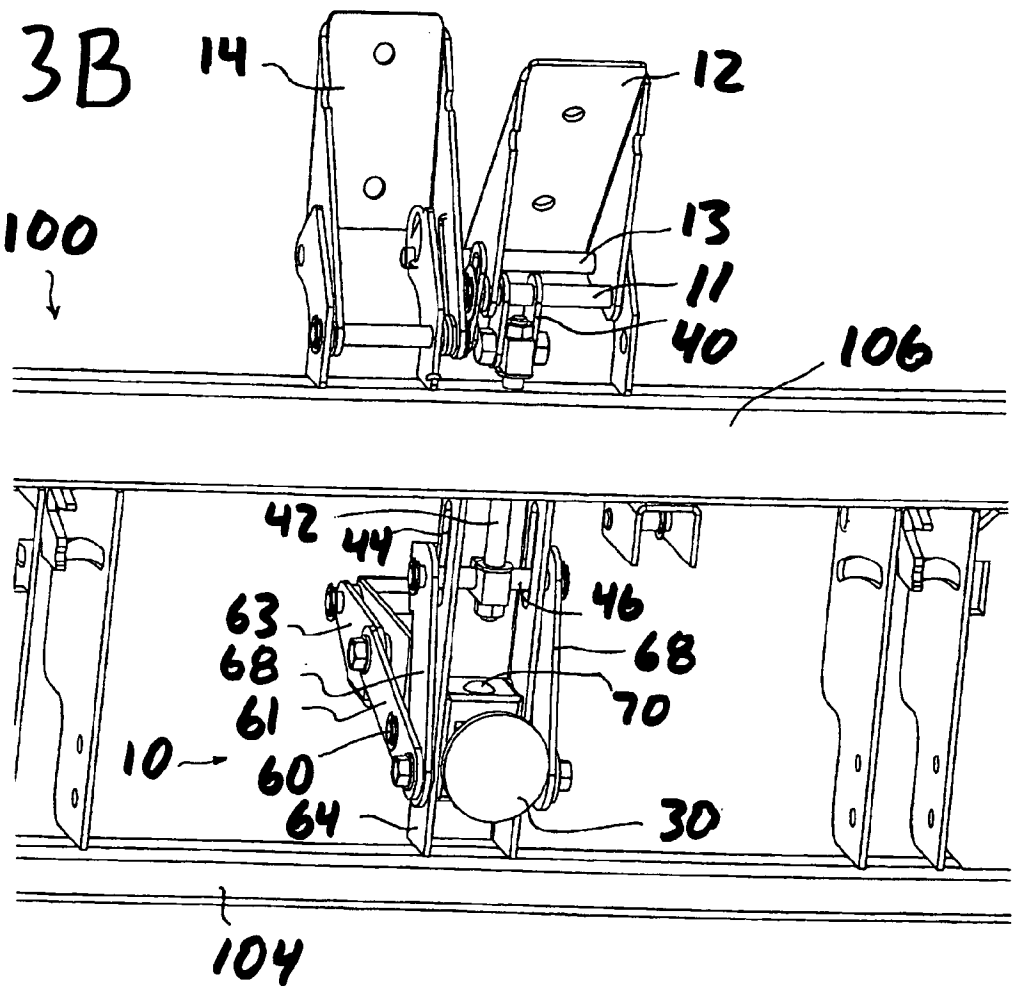
FIG. 3B is the view of FIG. 3A taken from a different direction.
Figure 3C:
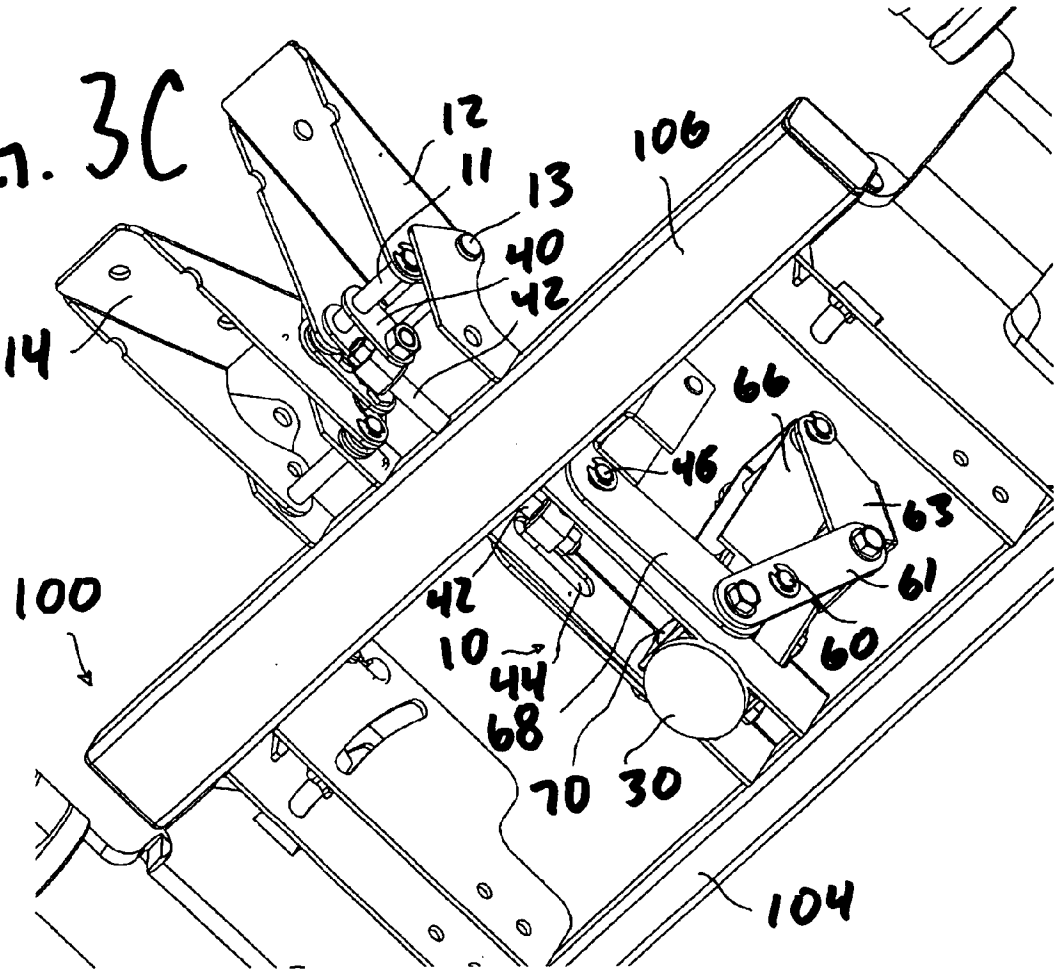
FIG. 3C is the view of FIG. 3A with the brake in an unlocked position.

Now, referring to the other figure, one embodiment of a locking mechanism 10 for a hospital bed 102 is illustrated. Referring specifically to FIG. 3A, a perspective view from below the undercarriage 100 and locking mechanism 10 with the brake in a locked position, locking pedal 12 and unlocking pedal 14 are pivotably mounted to support member 106 of undercarriage 100. At least one of the pedals 12, 14 is operably connected to a brake member 31, such that the locking pedal 12 is capable of moving the brake member 31 up and down vertically, so that brake pad 30, which is attached to the end of brake member 31, may be forced into contact with a floor beneath the undercarriage 100 of hospital bed 102 by depressing locking pedal 12. Linkage members, as best shown in FIGS. 3A and 3C, are designed to convert the pivoting motion of locking pedal 12 to an up-and-down motion of the brake member 31.

Referring again specifically to FIG. 3A, the locking pedal 12 is pivotably mounted by a pin 13 to support member 106 of the undercarriage 100. The locking pedal 12 is operably connected to a transit rod 42 by a coupling pin 11 and a transit rod linkage 40, which is adapted to pivot in relation to both the locking pedal 12 and the transit rod 42. Transit rod 42 passes through a hole in the support member 106, which allows the bed 102 to be fully lowered to its lowest position without interference from the locking mechanism 10, while maintaining a rolling clearance of 20 mm. Thus, the locking mechanism 10 may be specifically designed to meet the standards of the hospital industry and Underwriter's Laboratories.

Figure 4:
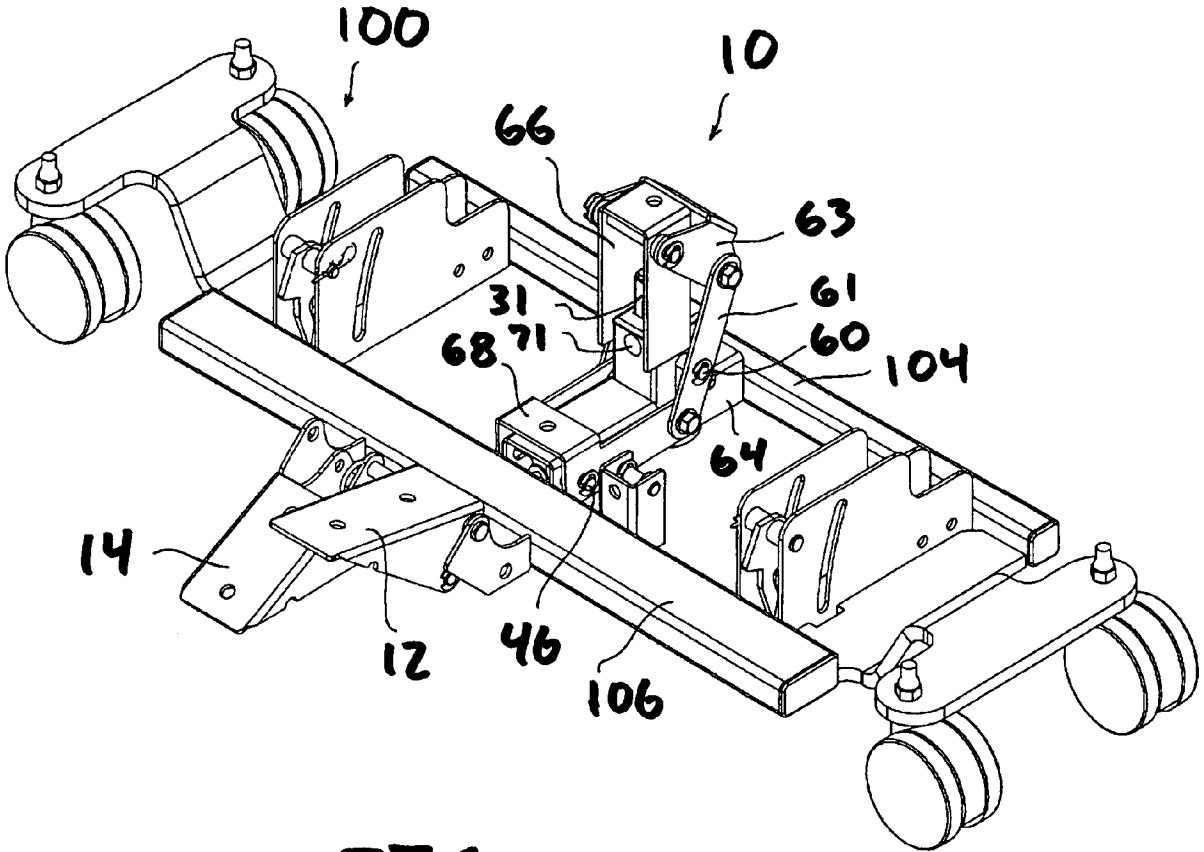
FIG. 4 is a perspective view from above the undercarriage and locking mechanism with the brake in an unlocked position.

The transit rod 42 is pivotably connected to transit link 68 by transit pin 46, which is attached to transit pin 42 and passes outwardly through slots 44 in horizontal brake frame 64, and is adapted to move one end of transit link 68 in a back-and-forth direction. Horizontal brake frame 64, a channel-like element in which transit rod 42 is disposed, is fixedly mounted between support members 104,106 of undercarriage 100. Preferably, the back-and-forth motion of transit link 68 is parallel to the floor, such that an adequate floor clearance (e.g., at least 20 mm) is maintained for component parts of the locking mechanism 10 that are near the edge of the bed. This helps to avoid accidental pinching of any errant foot that may be extending under the edge of the bed below the locking mechanism. The opposite ends of the transit link 68 are pivotably connected to ends of connecting links 61. In turn, the opposite ends of connecting links 61 are pivotably attached to locking link 63, which is pivotably connected to vertical brake frame 66. Finally, the vertical brake frame 66 is fixedly mounted to brake sleeve 32, which, in turn, is fixedly mounted to horizontal brake frame 64. In the preferred embodiment, a pair of connecting links 61 are each pivotably connected on opposite sides of the transit link 68 at one end of the connecting links 61 and to opposite sides of the locking link 63 on the opposite end of the connecting links 61, as shown more clearly in FIG. 4.

In an alternate embodiment embodiment, the transit rod 42 may be extended to the opposite end of the bed 102, such that the extended transit rod 42 is operably connected to a second brake member 31, which functions as a brake on the opposite end of the bed 102. Thus, brake members 31 on both ends of the bed 102 (e.g., head and foot brakes) may be operable by a single set of locking and unlocking pedals 12,14. Alternatively, the opposite end of the bed may be mounted on non-pivoting wheeled base, such that only one brake member 31 would be capable of preventing movement of the bed when the locking mechanism 10 is engaged. In still another alternative embodiment, a pair of brake members 31 is located near opposite sides of undercarriage 100 and is operably connected on opposite ends of a crosslinking member, such as an extended transit pin 46. In one preferred embodiment, the brake member 31 is not centered (by center of gravity) on the undercarriage 100, but is displaced toward one or the other edge. Thus, when the locking mechanism 10 is activated, the brake member 31 preferably lifts only one side of the undercarriage 100 from the floor, the other side of the undercarriage 100 remaining in contact with the floor.

A connecting pin 60 operably connects connecting links 61 to brake member 31, passing through slots 62 in brake sleeve 32, such that up-and-down movement of the connecting pin 60, as will be described in greater detail below, translates the brake member in an up-and-down direction.

Figure 6A:
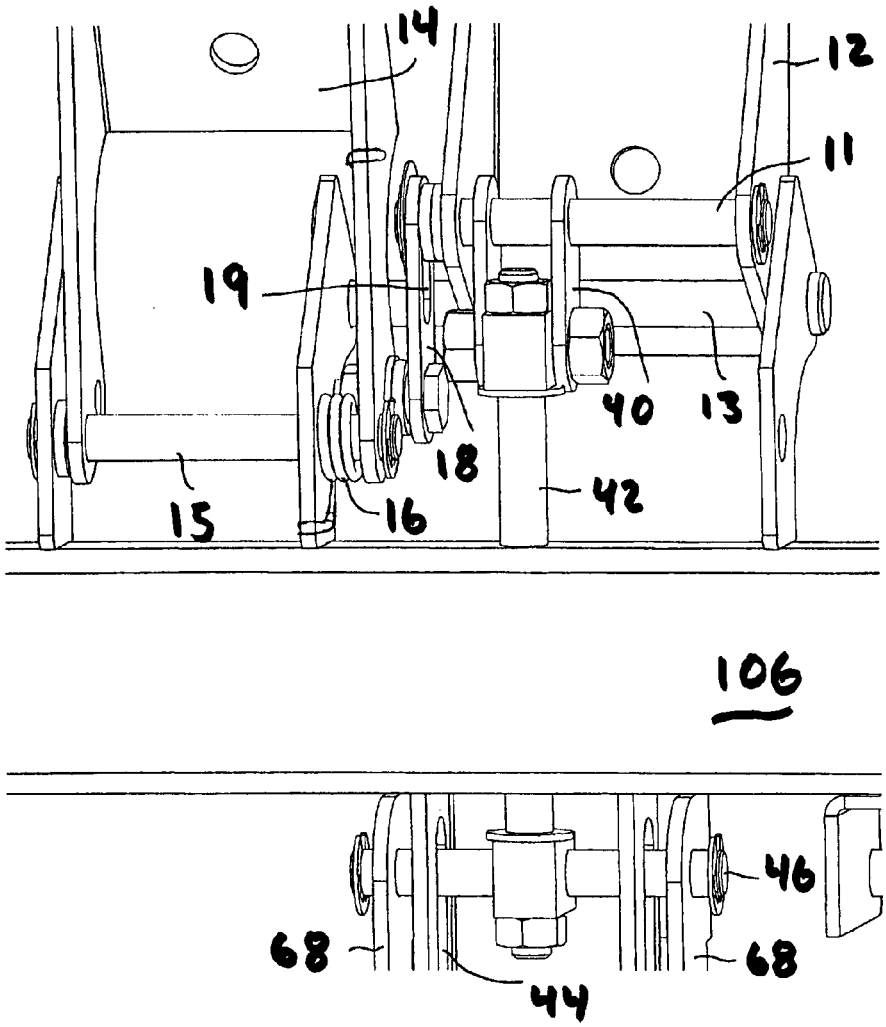
FIG. 6A is a view from below the locking and unlocking pedals when the brake is in an unlocked position.
Figure 6B:
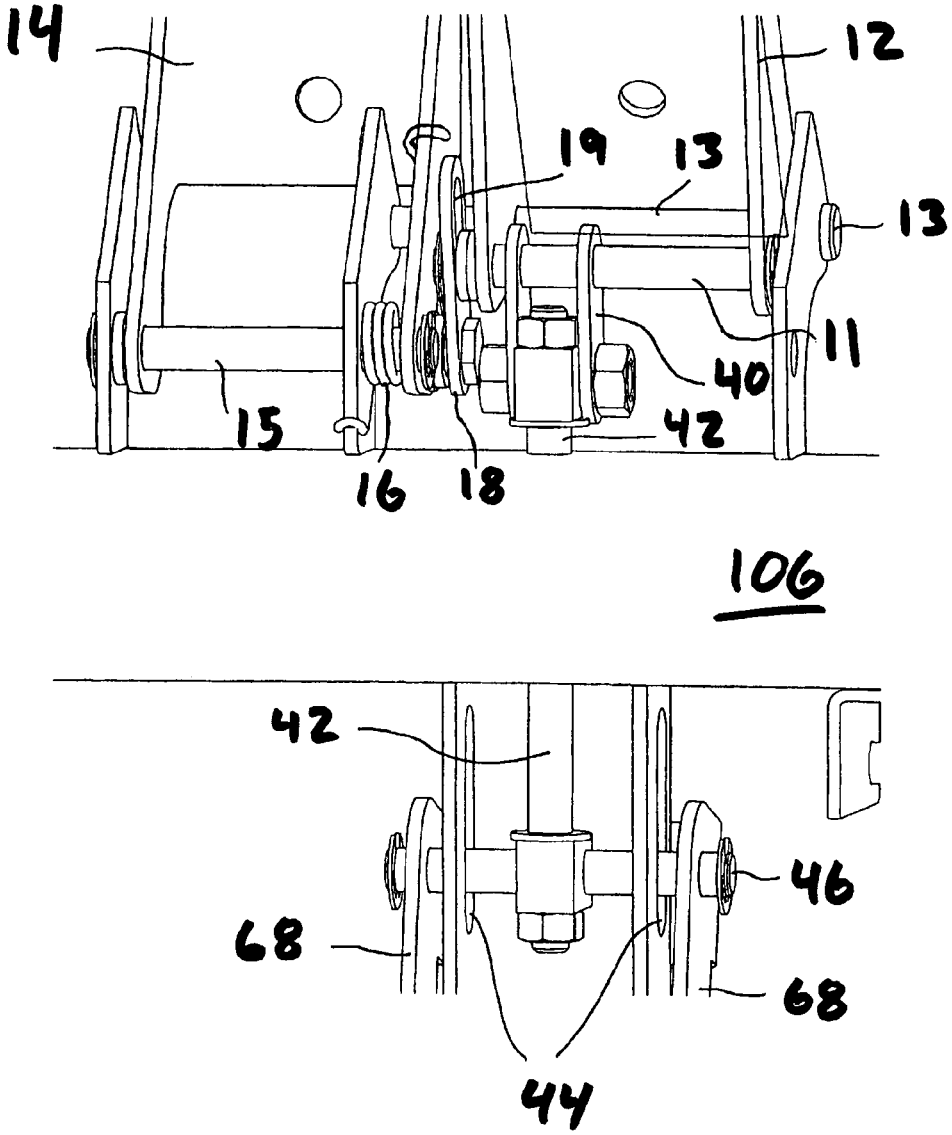
FIG. 6B is the view of FIG. 6A when the brake is in a locked position.
Figure 6C:
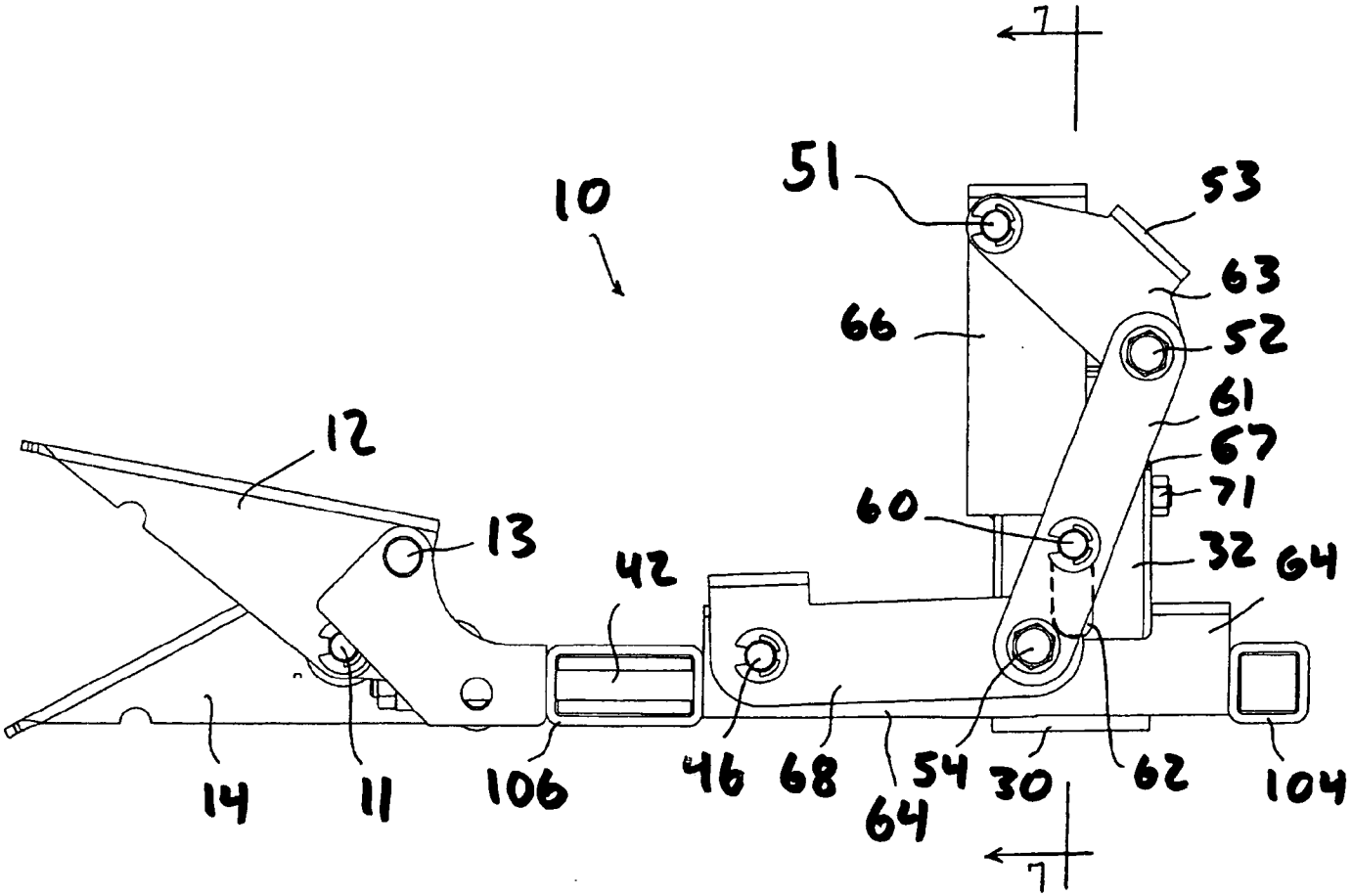
FIG. 6C is a side plan view of the locking mechanism with the brake in an unlocked position.
Figure 6D:
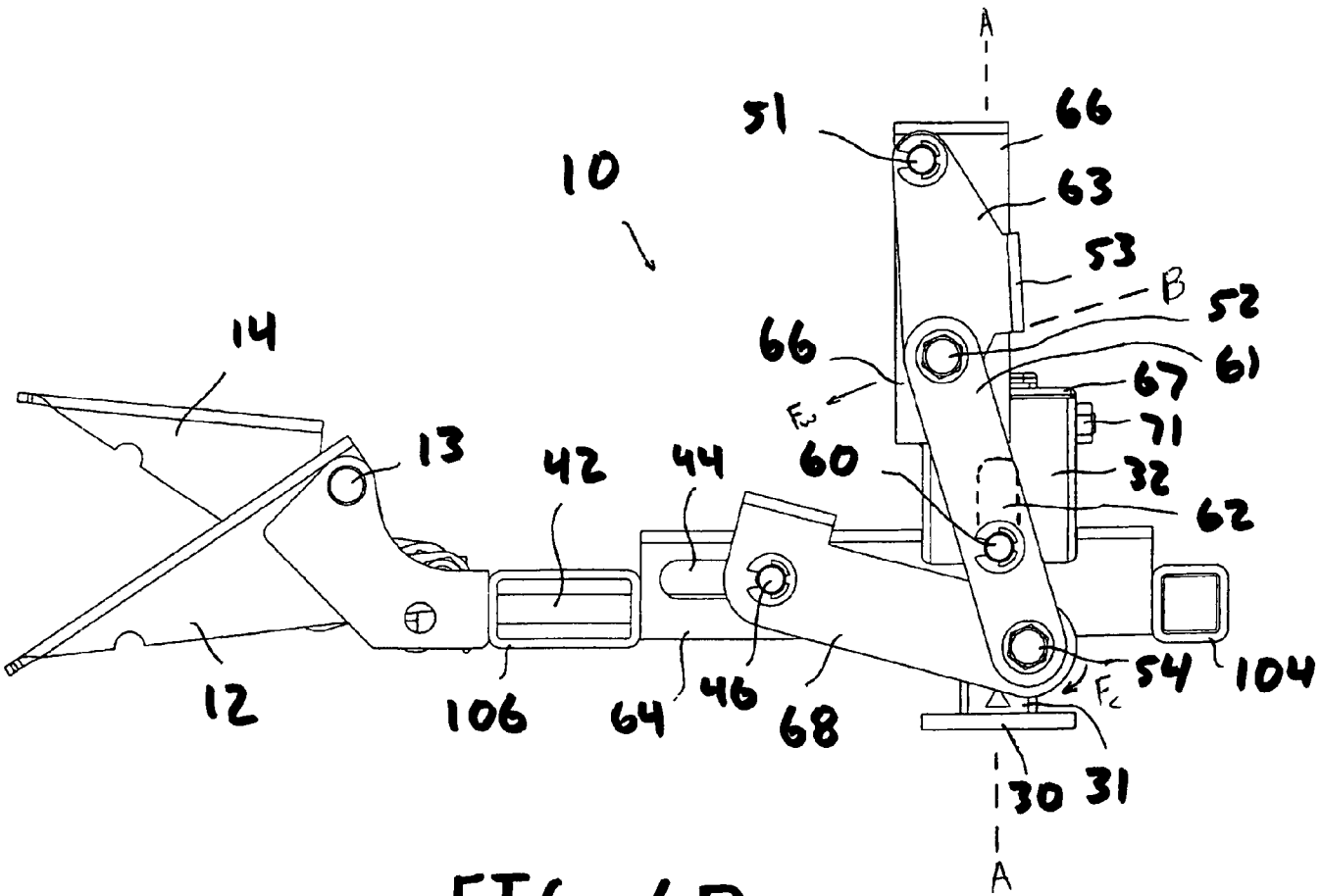
FIG. 6D is the view of FIG. 6C with the brake in a locked position.

Referring now to FIGS. 6C and 6D, connecting pin 60 slides up-and-down in slot 62, when transit link 68 moves back-and-forth and acts upon connecting links 61. In a preferred embodiment, a pair of slots 62 are defined by openings in opposite sides of brake sleeve 32. Brake member 31 reciprocates in brake sleeve 32 and is centered in brake sleeve 32 by an upper brake glide 67 and a lower brake glide 69, shown, for example, in FIG. 3A, fixed on opposite ends of the brake sleeve 32. The upper brake glide 67 is fastened to brake sleeve 32 by screw 71, and the lower brake glide is fastened to brake sleeve 32 by screw 70, shown, for example in FIG. 3A. Both screws 70,71 pass completely across brake sleeve 32 and through slots in reciprocating brake member 31.

As transit link 68 is moved to the right in FIG. 6C by transit rod 42, when locking pedal 12 is depressed, connecting link 61 pivots about the connecting pin 60. The pivoting of the connecting link 61 in a counter-clockwise direction, as viewed in FIGS. 6C and 6D, causes locking link 63 to pivot in a clockwise direction, as shown in FIGS. 6C and 6D, about pivot axis 51.

FIG. 6D shows locking pedal 12 in the fully depressed position. In this position, stop member 53, which may be an integral part of locking link 63, contacts the vertical brake frame 66. A locking axis 52, which is the axis of rotation between the connecting link 61 and the locking link 63, is extended to a locking position. As seen in FIG. 6D, the locking position of locking axis 52 extends beyond the plane A which bisects connecting pin 60.

Figure 7:
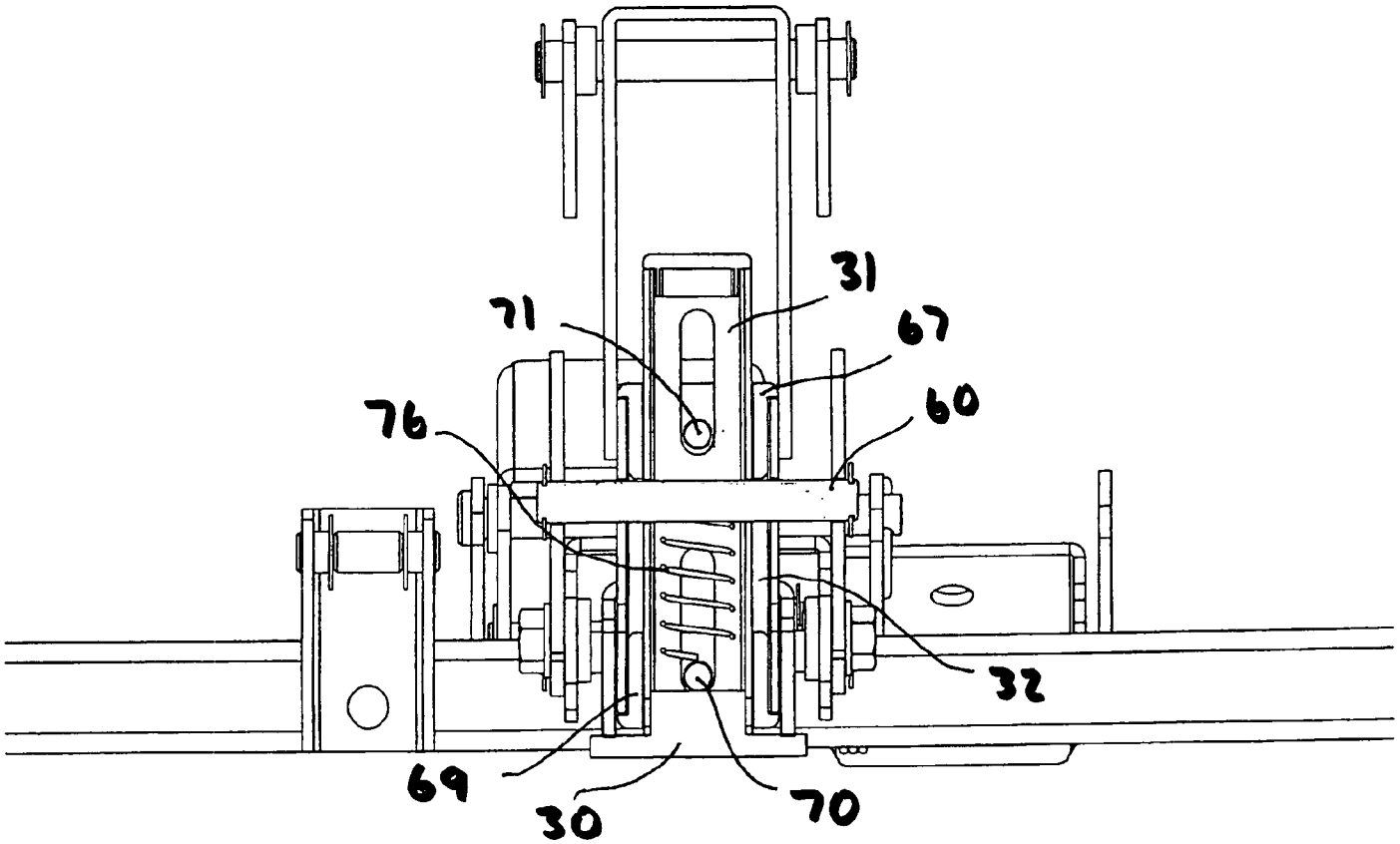
FIG. 7 is a cross-sectional view taken as indicated in FIG. 6C.

In a preferred embodiment, a biasing mechanism, shown in FIG. 7 as a compression spring, is operably inserted between the brake member 31 and the brake sleeve 32, such that an upward biasing force is applied to the brake member 31, and more specifically to connecting pin 60. In the fully depressed position, as shown in FIG. 6D, the upward force on connecting pin 60 is transferred from the connecting pin 60 to a linking axis 54, connecting links 61 to transit link 68. As a consequence, linking axis 54 tends to rotate the end of connecting link 61 in a counter-clockwise direction about locking axis 52, applying a tangential bias force $F_w$ at locking axis 52.

Now, referring to FIGS. 6A and 6B, which are views of the locking and unlocking pedals 12,14 taken from below when the locking mechanism 10 is unlocked and locked, respectively, pedals 12,14 are operably linked to one another by pedal coupling mechanism 18. Coupling mechanism 18 includes a coupling slot 19, which engages coupling pin 11 and provides play between locking pedal 12 and unlocking pedal 14. Locking pedal 12 is not engaged by unlocking pedal 14 until coupling pin 11 is translated across slot 19 to the position shown in FIG. 6B. By pressing unlocking pedal 14, in FIG. 6B where the locking mechanism 10 is locked, which unlocking pedal 14 pivots around pin 15, from which coupling mechanism 18 is offset, coupling mechanism 18 is able to push against coupling pin 11 causing it to pull transit rod 42 and unlock the locking mechanism 10.

In other words, locking pedal 12 pivots about pin 13, while unlocking pedal 14 pivots about pin 15. Pin 13 is mounted from support member 106 at points above, relative to a floor on which the undercarriage 100 rests, the points from which pin 15 is mounted, so that the pivoting axis of locking pedal 12 is above that of unlocking pedal 14. Coupling pin 11 on locking pedal 12 is below pin 13, so that, when locking pedal 12 is depressed, coupling pin 11, in effect, pushes in on transit rod 42 to lock locking mechanism 10. On the other hand, coupling mechanism 18 is attached to unlocking pedal 14 at a point above pin 15, about which unlocking pedal 14 pivots. As a consequence, when unlocking pedal 14 is depressed, coupling mechanism 18, or, more specifically, the end of slot 19 as shown in FIG. 6B, engages coupling pin 11 and, in effect, pushes transit rod 42 out to unlock locking mechanism 10.

In a preferred embodiment, a biasing device 16, such as a torsion spring, applies an upward bias on unlocking pedal 14. This provides positive feedback to a user, while returning unlocking pedal 14 to the position shown, for example, in FIG. 6C after unlocking the locking mechanism 10.

In FIG. 6A, the locking mechanism 10 is in the unlocked position, and the transit rod 42 is pushed in the direction of connecting pin 11 by the biasing mechanism. Preferably, the biasing mechanism is located in the brake sleeve 32, as shown in FIG. 7. However, it should be understood that the biasing mechanism may be located elsewhere in the locking mechanism 10, as will be understood by one of ordinary skill in the art. Preferably, the biasing mechanism is a compression spring, which is capable of providing a force in a range from about 15 to about 20 pounds between the fully unlocked and locked positions, respectively. In contrast, the biasing device 16, which provides feedback to the user, has a force preferably within a range of about 1.5 to about 5 pounds, when in the locked position and the depressed position, respectively. Thus, the biasing device 16 may be a torsion spring that is capable of providing feedback to the user when depressing the unlocking pedal 14 of the locking mechanism 10.

For example, when the unlocking pedal 14 is pressed, the coupling mechanism 18 engages the coupling pin 11, causing it to pull outwardly, or to the left in FIG. 6D, on the transit rod 42. In turn, transit link 68 imposes a force on linking axis 54 causing a counter-rotational force $F_c$ to overcome the tangential bias force $F_w$, displacing the locking axis 52 to the right and unlocking the locking mechanism 10. As shown in FIG. 6D, as the locking axis 52 moves along the dashed line B, the locking axis 52 breaks the plane A, and the force of the biasing mechanism in brake sleeve 32, acting upwardly on connecting pin 60, returns the brake member 31 and the locking pedal 12 to the unlocked position, as shown in FIG. 6C. In an alternative embodiment, an electric device, such as a linear actuator, may be used to actuate movement of the locking axis 52 across the plane A, allowing the biasing mechanism to return the brake member 31 to the unlocked position.

When in the unlocked position, it is preferable to have at least 20 millimeters (mm) of clearance between the floor and the brake pad 30. Thus, the throw of the brake member 31 is preferably at least 20 mm. Thus, the dimensions of the locking mechanism 10 are preferably selected to provide the brake member 31 with at least 20 mm of throw.

FIG. 7 is a cross-sectional view taken as indicated in FIG. 6C. Compression spring 76 is shown in cross section within brake member 31 between connecting pin 60 and screw 70. There it biases connecting pin 60 in an upward direction, keeping the locking mechanism in a locked condition when required, and releasing it when a user steps on the unlocking pedal 14.

Although the present invention has been described in relation to particular embodiments thereof, many other variations and modifications and other uses will become apparent to those skilled in the art. Thus, the present invention is not limited to the specific examples herein.

What is claimed is:

1. A locking mechanism for a hospital bed, said locking mechanism being mounted on at least one support member of an undercarriage of said hospital bed, said locking mechanism comprising:

a locking pedal mounted on said support member;

an unlocking pedal mounted next to said locking pedal on said support member;

a horizontal brake frame mounted on said support member;

a brake sleeve mounted vertically on said horizontal brake frame;

a brake member disposed within said brake sleeve, said brake member being vertically reciprocatable within said brake sleeve and having a brake pad at one of two ends for contact with a floor when said locking mechanism is engaged;

a mechanical linkage between said locking and unlocking pedals and said brake member, said mechanical linkage including:

a) a transit rod, said transit rod being movable in one direction when said locking pedal is depressed and in an opposite direction when said unlocking pedal is depressed;

b) means for moving said transit rod in said one direction when said locking pedal is depressed and in said opposite direction when said unlocking pedal is depressed;

c) a transit link operatively connected to said transit rod;

d) at least one connecting link having a first end and a second end, said first end of said at least one connecting link being pivotably connected to said transit link;

e) a connecting pin, said connecting pin being pivotably connected to said at least one connecting link at a point between said first and second ends, said connecting pin being connected to said brake member and adapted to reciprocate it vertically within said brake sleeve;

f) means for biasing said connecting pin in an upward direction;

g) a vertical brake frame extending above said brake sleeve and fixedly attached thereto; and h) a locking link, said locking link being pivotably attached to said vertical brake frame and to said second end of said connecting link, said locking link pivoting toward said vertical brake frame to a position locking said brake member in a down position when said locking pedal is depressed.

2. A locking mechanism as claimed in claim 1 wherein said locking pedal is of a red color.

3. A locking mechanism as claimed in claim 1 wherein said unlocking pedal is of a green color.

4. A braking member as claimed in claim 1 wherein said brake pad is of a material having a high coefficient of friction relative to a floor.

5. A braking member as claimed in claim 1 wherein said brake pad is of rubber.

6. A braking member as claimed in claim 1 wherein said biasing means is a compression spring within said brake member acting upward on said connecting pin.

7. A locking mechanism as claimed in claim 1 wherein said means for moving said transit rod comprises a coupling pin on said locking pedal, said coupling pin being pivotably connected to said transit rod by a coupling link, so that, when said locking pedal is depressed, said coupling pin moves said transit rod in one direction, said means for moving said transit rod further comprising a coupling mechanism on said unlocking pedal, said coupling mechanism being slidably connected to said coupling pin through a slot in said coupling mechanism, said coupling pin being adjacent to an end of said slot when said locking mechanism is locked, so that, when said unlocking pedal is depressed when said locking mechanism is locked, said coupling mechanism moves said transit rod in said opposite direction.

* * * * *